United States Patent [19]

Chiecchi

[11] 4,322,884

[45] Apr. 6, 1982

[54] METHOD OF INTRODUCING AN ANTI-MICROPHONY SPONGE INTO AN AIR-CORED COIL

[75] Inventor: Cesare Chiecchi, Castiraga Vidardo, Italy

[73] Assignee: U.S. Philips Corporation, New York, N.Y.

[21] Appl. No.: 94,627

[22] Filed: Nov. 15, 1979

[30] Foreign Application Priority Data

Nov. 17, 1978 [IT] Italy ..... 29904 A/78

[51] Int. Cl.[3] ..... H01F 41/00

[52] U.S. Cl. ..... 29/602 R; 29/235; 29/451

[58] Field of Search ..... 29/602 R, 605, 451, 29/234, 235; 336/208

[56] References Cited

U.S. PATENT DOCUMENTS

| | | | |
|---|---|---|---|
| 1,702,031 | 2/1929 | Wesseler | 29/235 |
| 3,145,464 | 8/1964 | Green | 29/235 X |
| 3,894,328 | 7/1975 | Jansson | 29/451 |

*Primary Examiner*—Carl E. Hall

*Attorney, Agent, or Firm*—Robert T. Mayer; Bernard Franzblau

[57] ABSTRACT

A device for introducing an anti-microphony sponge into an air-cored coil for television channel selectors comprising an axially displaceable hollow mandrel with an end portion which comprises two diametrically oppositely situated slots. Two blocking members can be introduced into the slots, after which cutting means are displaceable in a direction transversely of the axis of the mandrel. After the introduction of a length of spongy material into the mandrel, an air-cored coil is arranged on the end portion of the mandrel, after which the blocking means are moved into the slots so that the length of spongy material is clamped on both sides of the air-cored coil. Subsequently, the mandrel is withdrawn from the coil and the length of spongy material is cut in the zone between the blocking means and the withdrawn mandrel, a piece of spongy material then being left behind in the air-cored coil. After withdrawal of the blocking means to their starting position, the air-cored coil with the piece of spongy material is discharged from the device.

3 Claims, 10 Drawing Figures

METHOD OF INTRODUCING AN ANTI-MICROPHONY SPONGE INTO AN AIR-CORED COIL

The invention relates to a method of introducing an anti-microphony sponge into an air-cored coil for television channel selectors.

The introduction of pieces of sponge into air-cored coils for television channel selectors in order to prevent microphony in these coils is known per se.

Thus far, the sponges were introduced by hand after the winding of the coil on a winding machine.

The present invention has for an object to provide a method such that this operation can be executed in a faster and more efficient manner.

This object is achieved in accordance with the invention in that a length of a spongy material is introduced into a sleeve so that the end portion of the length is enclosed by the sleeve, an air-cored coil, whose inner diameter is substantially equal to the outer diameter of the sleeve is then slid onto the sleeve, after which the air-cored coil is blocked in the axial direction and the end portion of the length of spongy material is clamped on both sides of the air-cored coil. The sleeve is subsequently withdrawn from the blocked air-cored coil and is slid over the clamped length so that the portion of the length enclosed by the sleeve is exposed and engages the inner circumference of the air-cored coil. The portion of the length which is enclosed by the air-cored coil is then separated from the portion of the length situated in the sleeve, and ultimately the blocking of the air-cored coil and the clamping of the sponge introduced into the air-cored coil is removed so that the air-cored coil with anti-microphony sponge thus obtained is released.

Using the method in accordance with the invention, the introduction of pieces of sponge into air-cored coils for television channel selectors can be simply performed at a very high rate.

The invention also relates to a device for performing the method.

The device in accordance with the invention is characterized in that it comprises an axially displaceable mandrel which comprises a cylindrical end portion having an axial bore around which a coil can be arranged. The axial bore serves to accommodate a length of a spongy material. The device includes a set of diametrically oppositely situated slots in the cylindrical end portion, of the mandrel and two blocking members which can be displaced towards the axis of the mandrel from opposite directions until they project into the slots, thus enclosing and clamping said length of spongy material on both sides of the coil. Means are provided for the axial displacement of the mandrel which is displaced after the introduction of the blocking members into the slots, the end portion of the mandrel then being withdrawn from the coil. Also included are cutting means which are displaceable transversely of the axis of the mandrel and which serve to cut off a piece of sponge in the zone between the blocking members and the withdrawn end portion of the mandrel.

The device in accordance with the invention preferably comprises means for supplying compressed air which are activated simultaneously with a return movement of the blocking members in order to discharge the coil with the introduced, cut-off piece of sponge.

The main advantage of the device in accordance with the invention, of course, is the fact that manual operation is replaced by a mechanical operation, so that the manufacturing tolerances are much more constant and more accurate. Moreover, the device is very suitable for mounting directly behind the exit point of the winding machine and for synchronization therewith so that the operation directly succeeds that of the winding machine and can even take place simultaneously with the formation of a new coil by the winding machine. Thus, the production capacity of the winding machine is not reduced, while the overall efficiency of the operation is improved.

A practical embodiment of the device in accordance with the invention will be described in detail hereinafter with reference to the accompanying diagrammatic drawings in which FIG. 1 is a front view of the device;

Figure 1:
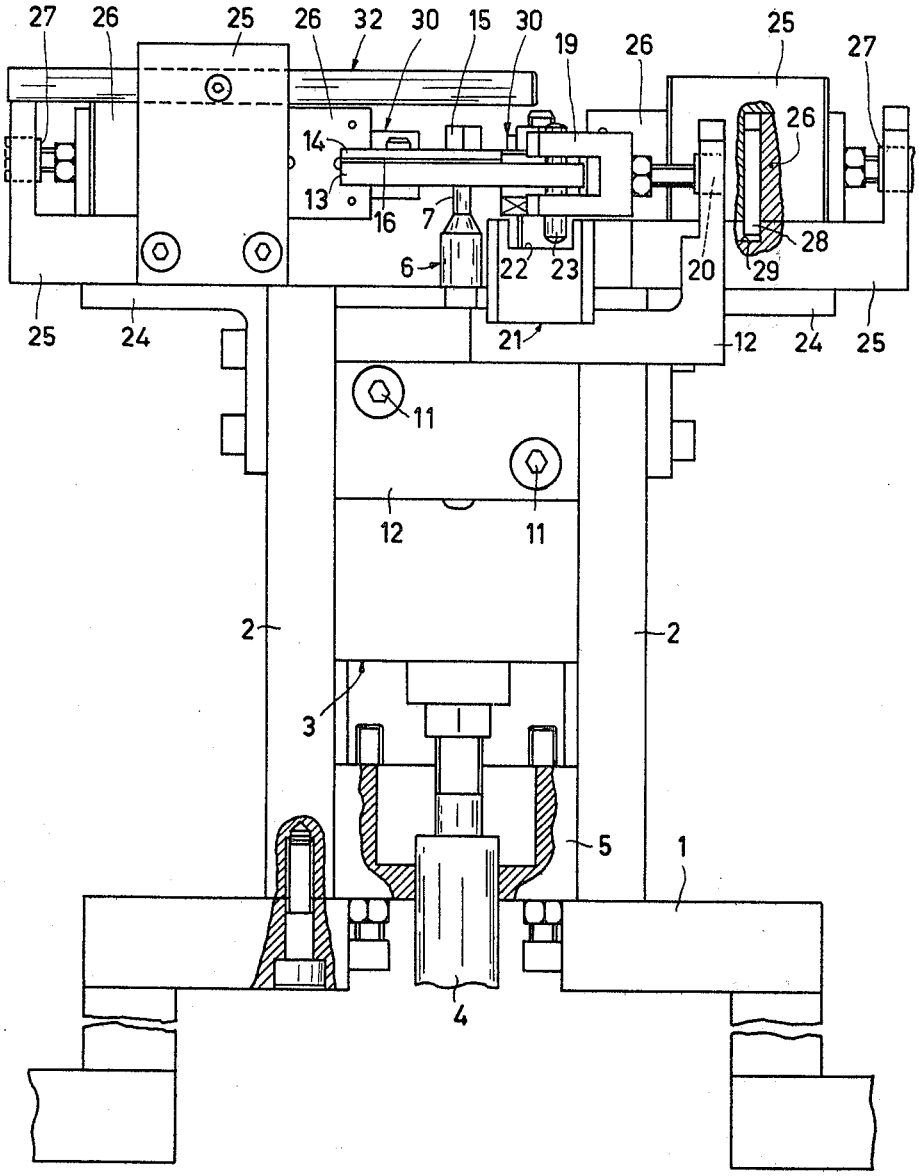
Figure 2:
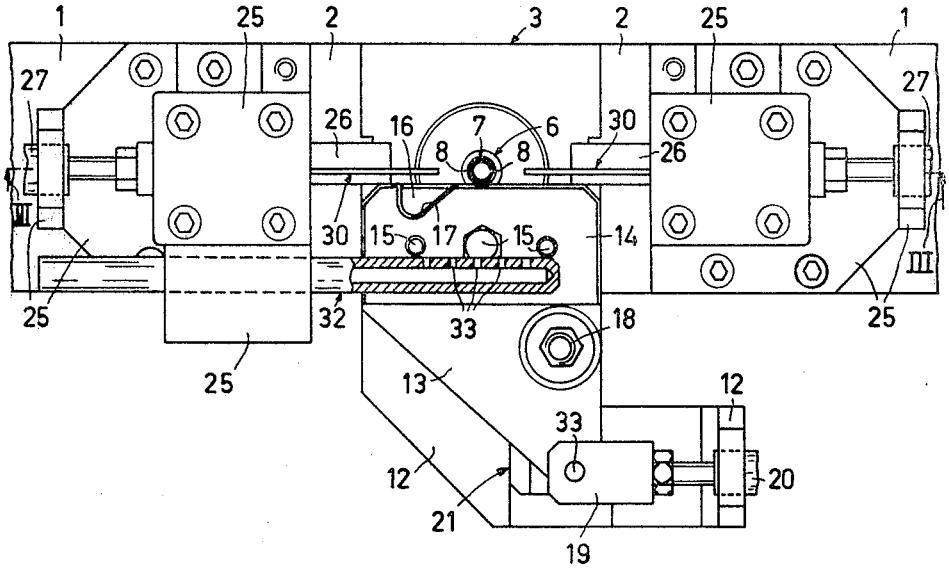
FIG. 2 is a plan view of the device.
Figure 3:
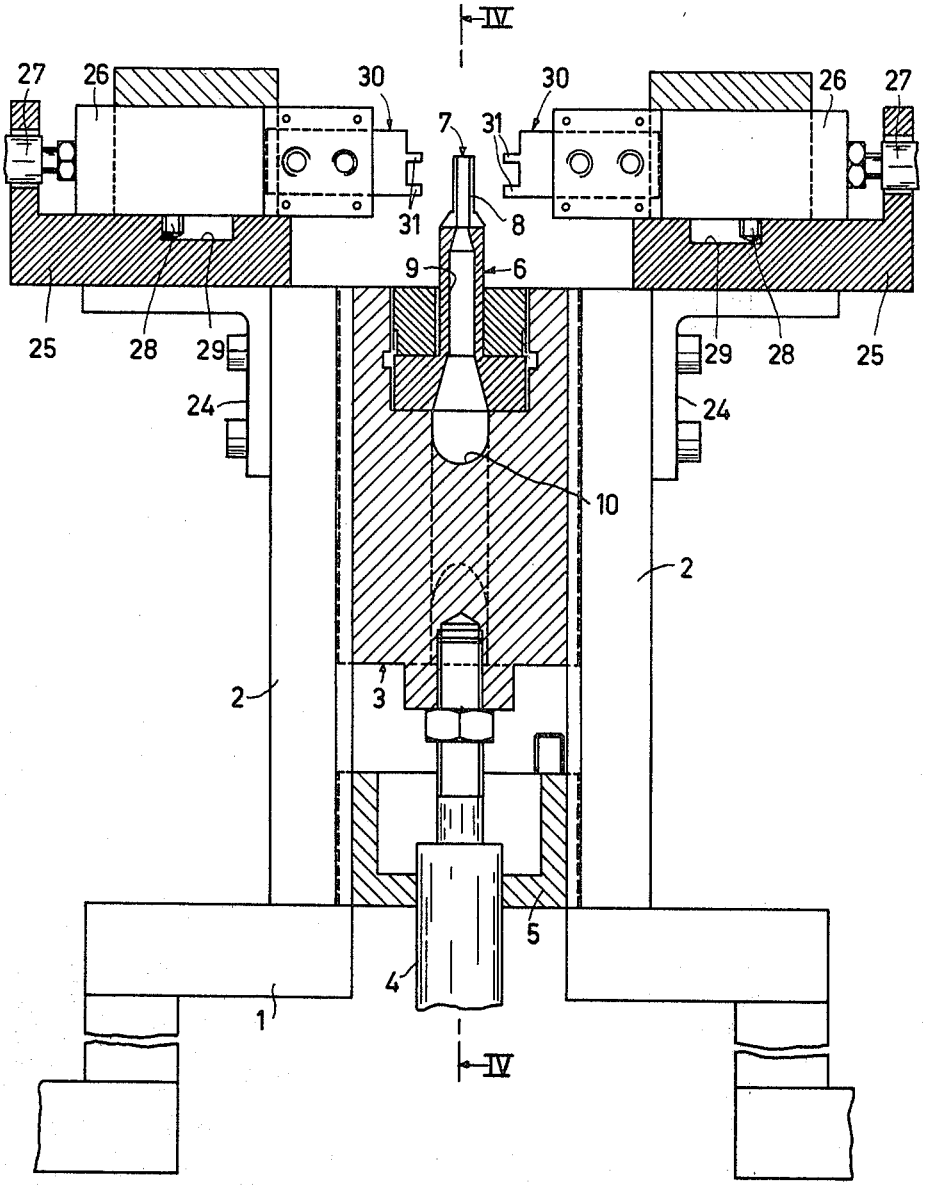
FIG. 3 is a sectional view of the device, taken along the line III—III in FIG. 2.
Figure 4:
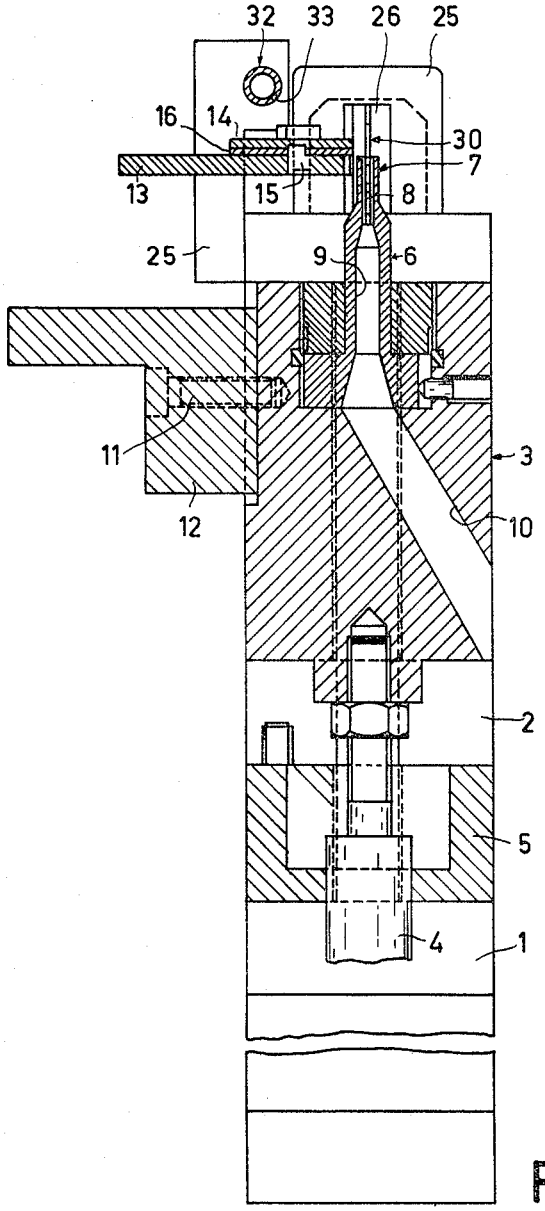
FIG. 4 is a sectional view of the device, taken along the line IV—IV in FIG. 3.
Figure 6:
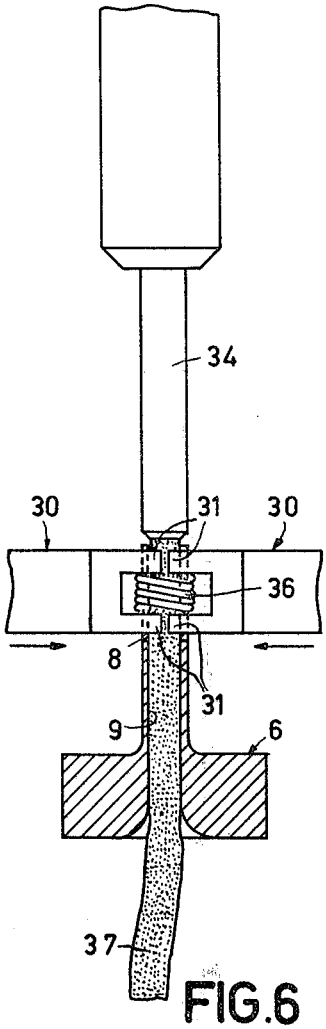
Figure 9:
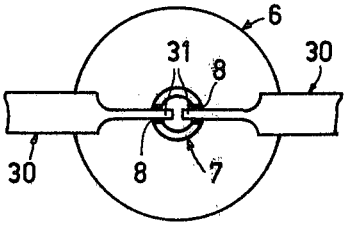
Figure 7:
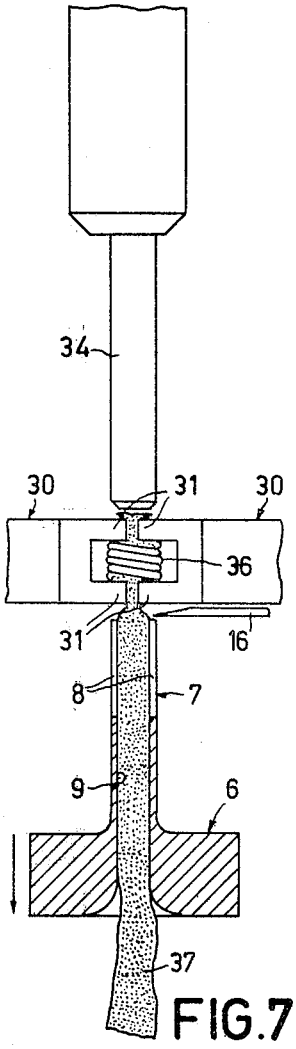
Figure 8:
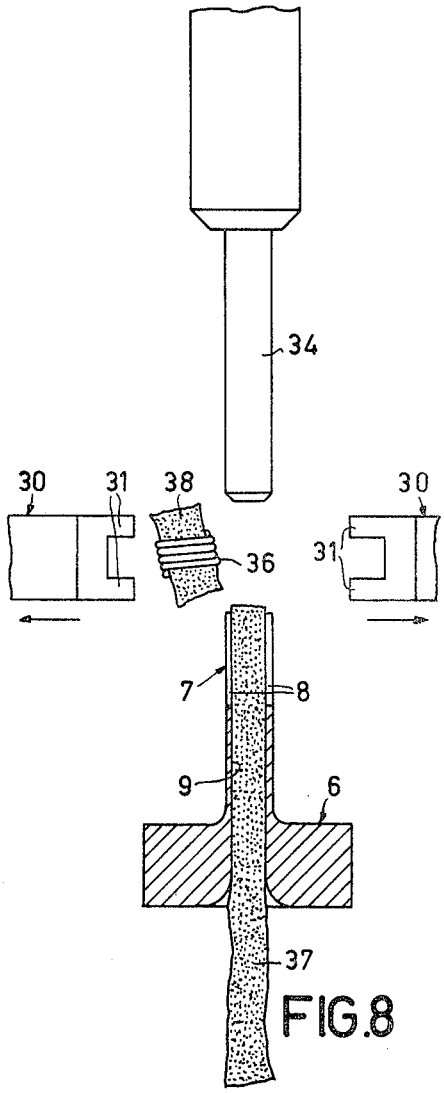
Figure 10:
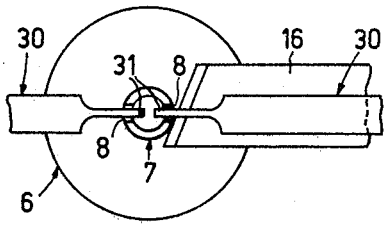

FIGS. 5 to 10 diagrammatically show successive steps in the device in sectional views as in FIG. 3;

FIGS. 9 and 10 diagrammatically illustrate the steps of the FIGS. 6 and 7 in a plan view.

The device shown in the FIGS. 1 to 4 comprises a basic frame 1 with a set of supports 2 which act as a guide for a vertically displaceable slide 3 which is supported and driven by the rod of a compressed air cylinder 4 which is mounted on the basic frame 1 by way of a block 5.

The slide 3 is rigidly connected to a mandrel 6 which comprises a cylindrical end portion 7 in which a set of slots 8 are diametrically oppositely provided. The mandrel 6 comprises a bore 9, the lower end of which communicates with an oblique duct 10 in the slide 3.

On the slide 3 there is secured, by means of screws 11, a support 12 for a pivotable plate 13 which cooperates with a counter-plate 14 which comprises pilot pins 15 for the positioning of a knife 16, the cutting edge of which is exposed at the area of a profiled window 17 in the counter-plate 14 (FIG. 2) in view of the cutting of the spongy material. The pivotable plate 13 is pivotably journalled, by means of a pin 18, on the support 12 and is driven via a pivot 23 and a fork 19 on the rod of a compressed air cylinder 20 mounted on the support 12. The pivoting movement of the pivotable plate 13 is limited by an abutment 21 which comprises a recess 22 for the displacement of the pivot 23.

On the supports 2 there are mounted, by way of L-shaped brackets 24, two blocks 25 for supporting and guiding a set of slides 26 which are situated on two opposite sides of the mandrel 6 (FIG. 3) and which are driven by compressed air cylinders 27. In conjunction with grooves 29 (FIG. 3) pins 28 guide the movements of the slides 26, each of which comprises a blocking member 30 which terminates in a set of teeth 31 which are arranged one above the other and which can be inserted into the slots 8 in the end portion 7 of the mandrel 6.

On the support 25 there is also secured a tube 32 which comprises openings 33 (FIGS. 1, 2 and 4) which are directed obliquely downwards and wherethrough compressed air can be supplied.

Figure 5:
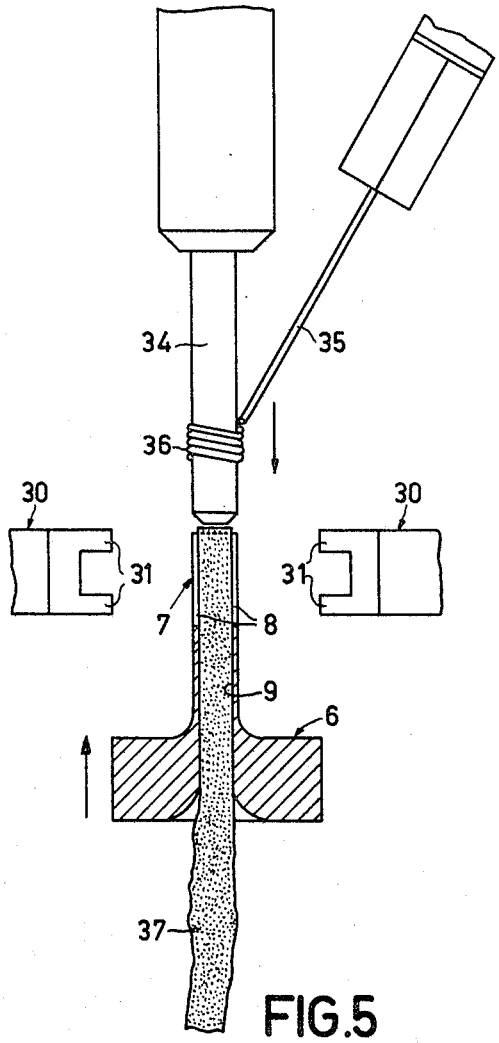

The operation of the device described above will be readily understood on the basis of the FIGS. 5 to 10 which diagrammatically illustrate the use of the device in direct cooperation with a winding machine. In FIG. 5, the blocking members 30 are remote from each other and the mandrel 6 bears on the slide 3 so that it occupies a position just below the winding mandrel 34 of a winding machine (not shown), while an ejector 35 which forms part of the winding machine slides a wound coil 36 off the mandrel 34 and onto the end portion 7 of the mandrel 6. The outer diameter of the end portion 7 equals the external diameter of the winding mandrel 34, and hence the internal diameter of the coil 36. A length 37 of a spongy material has previously been introduced, via the duct 10, into the bore 9 of the mandrel 6. Subsequently, the two compressed air cylinders 27 drive the slides 26 so that the two blocking members 30 are moved towards each other until the two sets of teeth 31 project into the slots 8, are closed around the coil 36 and together clamp the end portion of the length 37 which is present in the end portion 7 (FIGS. 6 and 9). When the compressed air cylinder 4 is actuated, the mandrel 6 is moved downwards, so that the end portion 7 is withdrawn from the coil 36 and is moved out of reach of the teeth. The end portion of the length 37 is then retained by the teeth 31, so that the length 37 is pulled through the duct 10 and the bore 9. As is shown in the FIGS. 7 and 10, the knife 16 is subsequently actuated by the compressed air cylinder 20, so that in the zone between the teeth 31 and the mandrel 6 a piece of sponge 38 is cut off from the length 37.

After withdrawal of the two blocking members 30, the coil 36 with the piece of sponge 38 inserted therein can be discharged in the transverse direction (FIG. 8) by means of compressed air which is supplied via the tube 32 and the apertures 33.

What is claimed is:

1. A method of introducing an anti-microphony sponge into an air-cored coil for television channel selectors which comprises, introducing a length of a spongy material into a sleeve so that an end portion of the length is enclosed by the sleeve, sliding an air-cored coil having an inner diameter substantially equal to the outer diameter of the sleeve onto the sleeve, blocking the air-cored coil in the axial direction and clamping the end portion of the length on both sides of the air-cored coil, withdrawing the sleeve subsequently from the blocked air-cored coil and sliding it over the clamped length so that the portion of the length enclosed by the sleeve is exposed and engages the inner circumference of the air-cored coil, separating the portion of the length which is enclosed by the air-cored coil from the portion of the length situated in the sleeve, and unblocking the air-cored coil and unclamping the sponge introduced into the air-cored coil so that the air-cored coil with anti-microphony sponge is released.

2. A method of making an inductor having a sponge core which comprises, introducing a length of sponge material into a cylindrical sleeve, placing the sleeve within a cylindrical coil having an inner diameter substantially equal to the outer diameter of the sleeve, clamping the sponge material at both ends of the coil so as to hold the sponge material within the coil and to prevent relative axial movement of the coil and the clamped sponge material, removing the sleeve from within the coil so that a part of the sponge material within the coil engages the inner surface of the coil, separating said part of the sponge material from the remainder of the sponge material, and unclamping the sponge material so as to release the coil with the sponge material core.

3. A method as claimed in claim 2 wherein the step of introducing the length of sponge material into the sleeve includes an axially displaceable mandrel having a cylindrical end portion with an axial bore to accommodate the sponge material and a pair of axial slots therein, said mandrel being movable in one axial direction to slide the coil around said end portion of the mandrel and being axially movable in the opposite direction, and said clamping step includes a pair of spaced apart opposed clamp members movable transversely of the mandrel axis so as to engage the sponge material within the coil via said axial slots in the cylindrical end portion of the mandrel.

* * * * *